US006195061B1

(12) United States Patent
Hizal et al.

(10) Patent No.: US 6,195,061 B1
(45) Date of Patent: Feb. 27, 2001

(54) MINIATURE SKEWED BEAM HORN ANTENNA

(75) Inventors: Altunkan Hizal, Ankara (TR); Christopher T. Lyons, Tyngsboro, MA (US)

(73) Assignee: Hittite Microwave Corp., Chelmsford, MA (US)

( * ) Notice: Subject to any disclaimer, the term of this patent is extended or adjusted under 35 U.S.C. 154(b) by 0 days.

(21) Appl. No.: 09/167,117

(22) Filed: Oct. 6, 1998

(51) Int. Cl.[7] ..... H01Q 13/00

(52) U.S. Cl. ..... 343/786; 343/779; 343/872; 455/351

(58) Field of Search ..... 343/779, 780, 343/786, 872, 772; 455/271, 351; H01Q 13/02, 13/00

(56) References Cited

U.S. PATENT DOCUMENTS

| | | | | |
|---|---|---|---|---|
| 4,482,898 | * | 11/1984 | Dragone et al. | 343/781 P |
| 4,613,989 | * | 9/1986 | Fende et al. | 455/351 |
| 4,734,660 | * | 3/1988 | Lofgren | 333/21 A |
| 5,245,353 | * | 9/1993 | Gould | 343/786 |
| 5,305,000 | * | 4/1994 | Harris | 343/786 |

* cited by examiner

*Primary Examiner*—Tho Phan
(74) *Attorney, Agent, or Firm*—Kirk Teska; Iandiorio & Teska

(57) ABSTRACT

A miniature horn antenna includes a housing forming a skewed beam sectoral horn, the housing forming first and second divergent walls having a primary axis in which at least one of the first and second divergent walls is transverse to the primary axis, a rear wall joining the first and second divergent walls, and a first side wall; a feed probe in front of the rear wall and between the first and second divergent walls; and a second side wall.

13 Claims, 6 Drawing Sheets

MINIATURE SKEWED BEAM HORN ANTENNA

FIELD OF INVENTION

This invention relates to horn antennas, and more particularly to a skewed beam sectoral horn antenna.

BACKGROUND OF INVENTION

In order for an antenna to be effective, it must radiate electromagnetic energy efficiently. That is to say, it must radiate as much energy as possible at the desired frequency, in the desired direction across the desired bandwidth. While antennas can be made to meet these requirements, they often are very expensive to manufacture due to the materials required and the labor necessary to produce them. The size of the antenna also plays an important role in determining which antennas are suited for a particular application. For example, when the application includes an anticipatory collision detection system which operates in the C-band range (4 GHz to 8 GHz) and must be located in the bumper of an automobile, size becomes critical while still maintaining the appropriate beam width and band width. A typical symmetrical horn antenna operating in this range is in excess of one foot in length.

One possible antenna for such an application is a two element patch array. However, this antenna is expensive to manufacture because it requires: expensive microwave materials, a separate printed circuit board which includes an antenna, and a special cover which must be custom tuned very accurately. The antenna must be oriented vertically to produce the desired radiation pattern in the appropriate direction limiting the placement and mounting of the antenna. Even then the beam width is well under 100°, requiring multiple antenna sections to produce a usable beam width. Moreover, the usable band width is less than 100 MHz. Thus, this antenna requires multiple manufacturing steps, expensive materials and labor, and yields less than favorable mounting, beam width and band width characteristics.

Another antenna includes the printed circuit dipole or microstrip dipole which has circuits etched on a printed circuit board which is then soldered perpendicularly to the printed circuit board containing the electronics. This results in a flimsy non-rigid structure which also requires a special cover, expensive manufacturing materials and multiple, expensive manufacturing steps to produce and assemble. This structure, like the previous antenna, suffers from similar shortcomings such as a narrow band width, a narrow beam width and a particular orientation which still produces a less than suitable radiation pattern. A typical band width is less than 100 MHz and the beam width is less than 100°. Moreover, this antenna produces high side lobes which, in the case of an anticipatory collision detection system, illuminates the ground increasing system noise, thereby increasing the chance of errors.

SUMMARY OF INVENTION

It is therefore an object of this invention to provide a miniature horn antenna which is small in size and cost effective to manufacture.

It is a further object of this invention to provide such an antenna where the electronics housing forms the antenna.

It is a further object of this invention to provide such an antenna which produces a beam width of approximately 180°.

It is a further object of this invention to provide such an antenna which is operable over a band width of over 300 MHz.

It is a further object of this invention to provide such an antenna which is less sensitive to tuning parameters.

It is a further object of this invention to provide such an antenna which can be adjusted to vary the beam tilt to accommodate various mounting positions.

It is a further object of this invention to provide such an antenna which radiates forward regardless of its physical orientation.

The invention results from the realization that a truly efficient and cost effective miniature horn antenna can be achieved by using the electronics housing to form a skewed beam sectoral horn by defining a rear wall, side wall and two divergent wall and placing the feed probe in front of the rear wall and between the divergent walls to eliminate the waveguide portion of the antenna.

The invention features a miniature horn antenna having a housing forming a skewed beam sectoral horn. The housing forms first and second divergent walls having a primary axis in which at least one of the first and second divergent walls is transverse to the primary axis, a rear wall joining the first and second divergent walls, and a first side wall. There is a feed probe in front of the rear wall and between the first and second divergent walls and a second side wall.

In a preferred embodiment, the feed probe may be capacitively coupled with the housing. The feed probe may extend through one of the first or second side walls and may have a flat end to capacitively couple the feed probe with the housing. The feed probe may have a conical shape, a cylindrical shape, or a disc shape. The feed probe may include a dielectric medium for capacitive coupling the feed probe with the housing. There may be a harmonic suppressor between the rear wall and the feed probe for minimizing radiation of a predetermined harmonic. The predetermined harmonic may include the second harmonic. There may be a tuning reflector parallel to one of the first or second divergent walls. The second side wall may be formed by the ground plane of a printed circuit board. The printed circuit board may include a microwave circuitry for providing electromagnetic energy to the feed probe. The other of the first and second divergent walls may be parallel to the primary axis.

The invention also features a miniature horn antenna includes a housing forming a skewed beam sectoral horn, the housing forming first and second divergent walls having a primary axis in which at least one of the first and second divergent walls is transverse to the primary axis, a rear wall joining the first and second divergent walls, and a first side wall. There is a feed probe in front of the rear wall and between the first and second divergent walls and a second side wall. There is a tuning reflector parallel to one of the first or second divergent walls.

In a preferred embodiment, the feed probe may be capacitively coupled with the housing. The feed probe may have a flat end to capacitively couple the feed probe with the housing. The feed probe may have a conical shape, a cylindrical shape, or a disc shape. The feed probe may include a dielectric medium for capacitive coupling the feed probe with the housing.

DISCLOSURE OF PREFERRED EMBODIMENT

Other objects, features and advantages will occur to those skilled in the art from the following description of a preferred embodiment and the accompanying drawings, in which.

Figure 1:
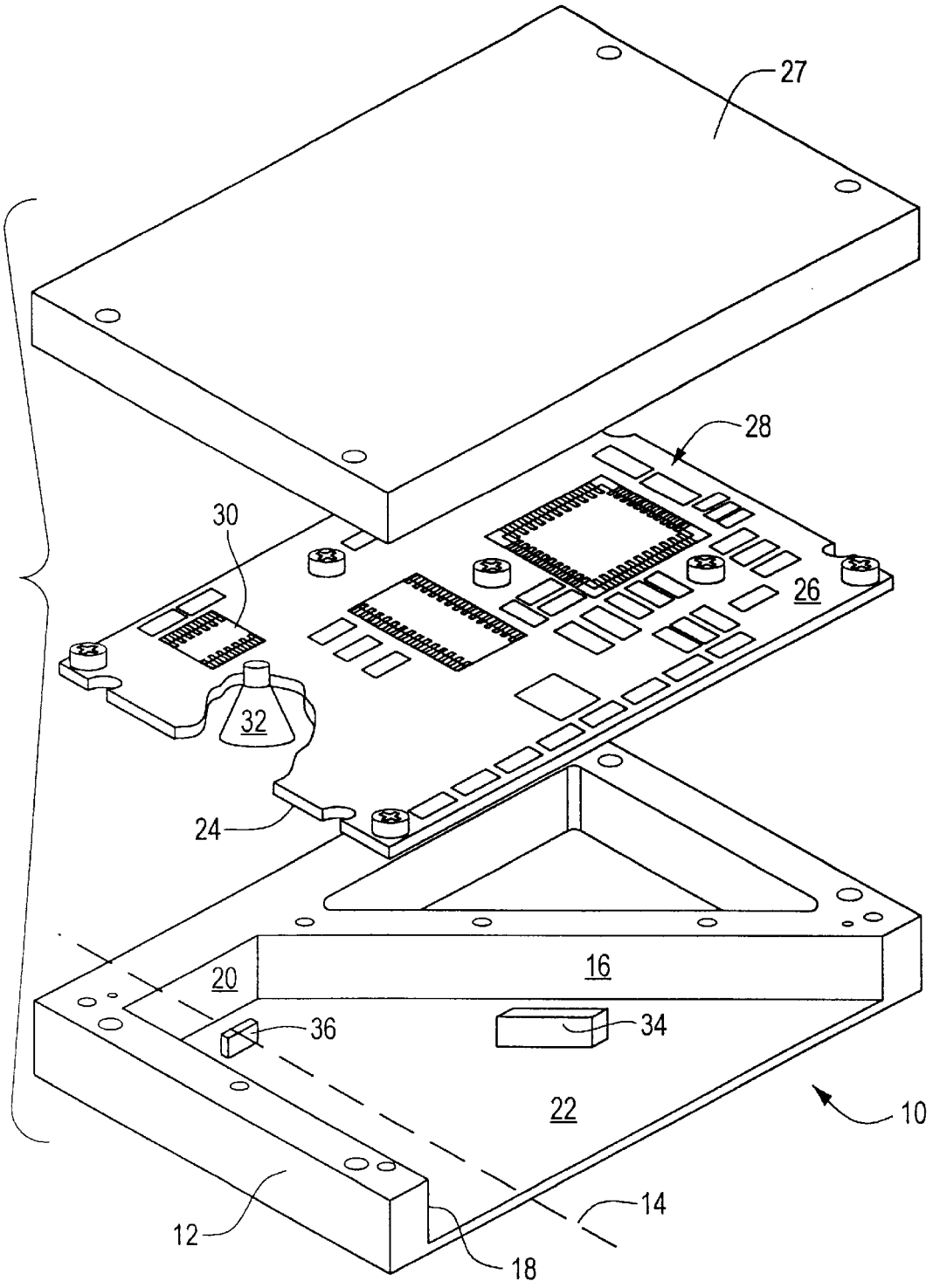
FIG. 1 is an exploded, isometric view of the miniaturized skewed beam horn antenna according to the present invention in which the ground plane of the printed circuit board forms one wall of the horn antenna.

Miniature horn antenna 10, FIG. 1, includes housing 12 which defines a skewed beam sectoral horn having divergent walls 16 and 18 connected by rear wall 20.

Figure 2:
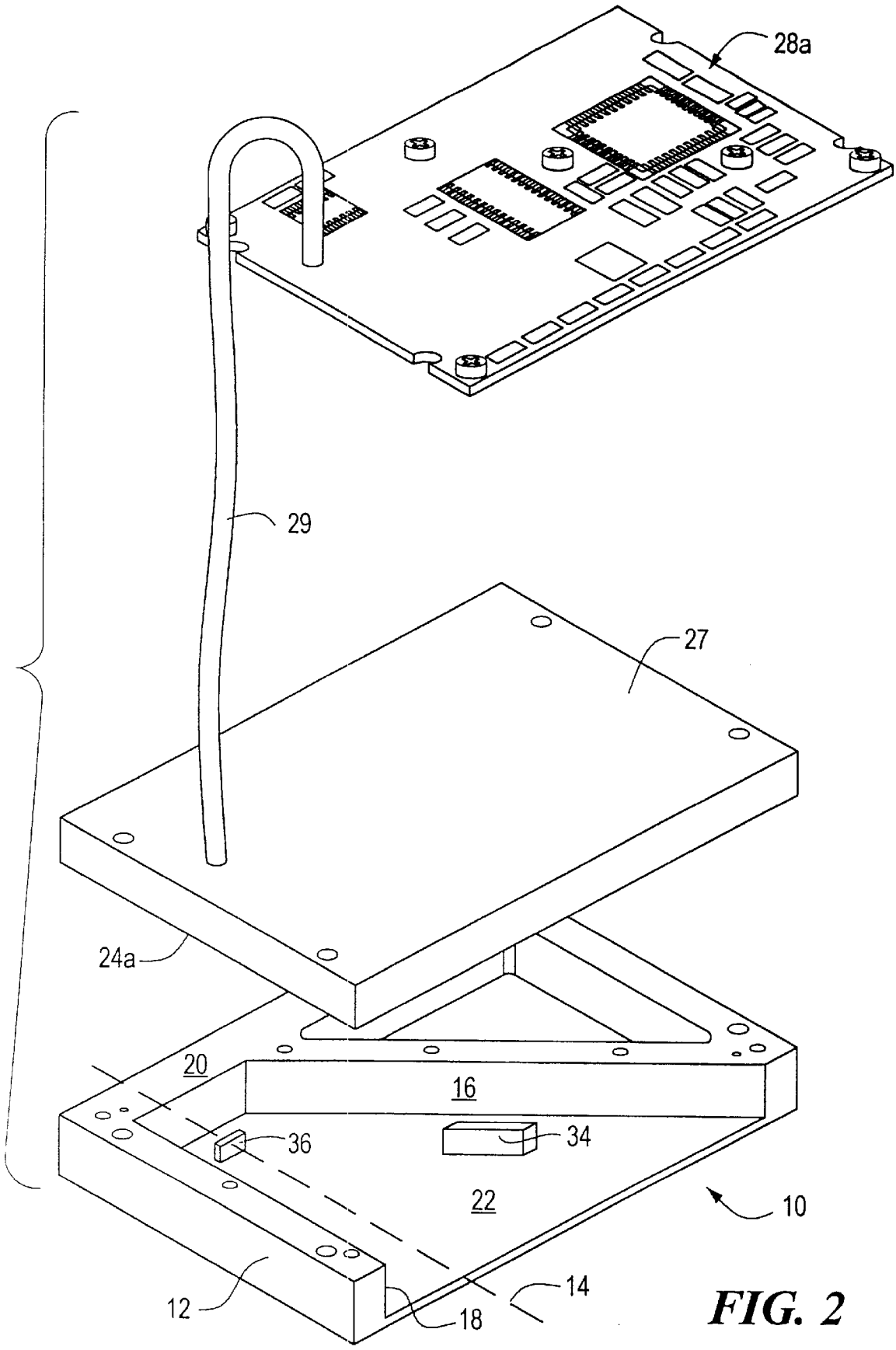
FIG. 2 is a view, similar to FIG. 1, in which electronics are not included in the antenna and the top of the package forms one wall of the antenna.

Housing 12 also defines side wall 22. In the preferred embodiment, second side wall 24 is defined by the ground plane of printed circuit board 26 which carries electronic circuitry 28 for producing electromagnetic energy radiated by antenna 10. However, this is not a necessary limitation of the invention as package cover 27, FIG. 2, may be used to form second side wall 24*a* and electronics 28*a* may be remote from antenna 10 and connected via coaxial cable 29.

Thus, utilizing the packaging to form the antenna and further using the printed circuit board to define a portion of the antenna not only reduces manufacturing steps and materials, but utilizes elements that are required anyway, namely, the housing and the circuit board ground plane. The housing may further be manufactured of any suitable material which will reflect the signal, from aluminum to reflectively coated plastic. Thus, the manufacturing costs are considerably less than existing antennas.

Electronic circuitry 28, may include, for example, a radar chip 30, such as the MMIC radar chip manufactured by Hittite Corporation of Massachusetts, which provides a radar signal, typically in the C-band (4 GHz to 8 GHz) to feed probe 32. Wall 16 may be transverse to primary axis 14 while wall 18 may be parallel to axis 14. However, this is not a necessary limitation of the invention, as wall 18 may also be transverse to primary axis 14.

Tuning reflector 34 is provided to vary the beam squint or tilt of the radiated beam with respect to primary axis 14. Harmonic suppressor 36 may also be provided to eliminate undesirable harmonics such as, in the case of a pre-crash sensor, the second harmonic. This suppressor is positioned where the harmonic to be eliminated will create a short circuit at feed probe 32. For example, to eliminate the second harmonic, suppressor 36 having a height one half the height of rear wall 20 would be placed a distance of 0.21" from the center of feed probe 32. The position to the probe center is preferably less than a quarter of a wavelength at the 2nd harmonic in order to exhibit low impedance. Moreover, due to the size of the conical probe, the 2nd harmonic electric field is effectively shorted.

A typical symmetrical sectoral horn antenna produces a main beam aligned with the primary axis. In order to match the impedance in free space, the flare angle is small and thus the antenna is long.

Figure 3B:
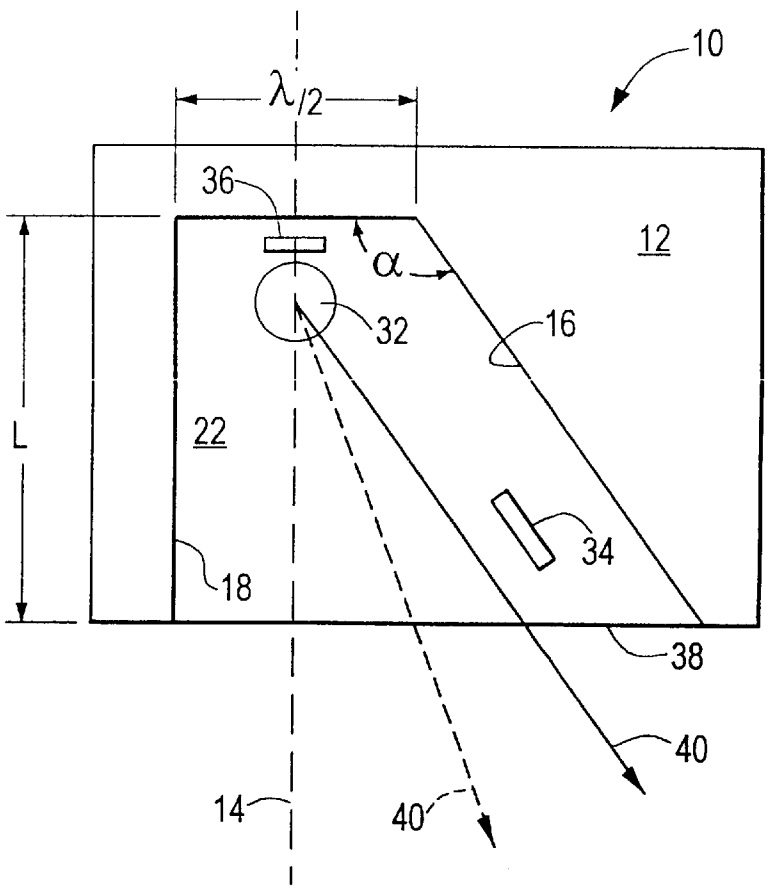
FIG. 3B is a schematic view, similar to FIG. 3A, in which the beam tilt is varied by changing the flare angle.
Figure 3A:
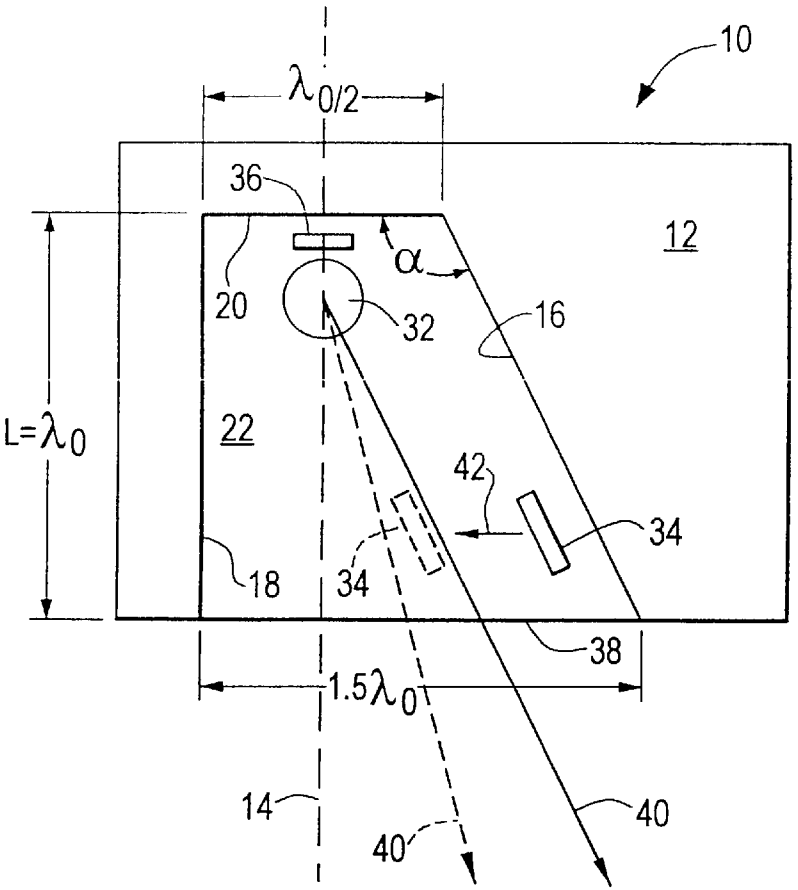
FIG. 3A is a schematic view of a miniaturized skewed beam horn antenna according to the present invention in which the beam tilt may be varied by repositioning the tuning reflector.

Flaring sectoral horn antenna 10, FIG. 3A, on only one side, wall 16, and eliminating the wave guide portion of the typical symmetrical horn antenna, provides a shorter, and thus a smaller horn antenna. A typical horn antenna includes a waveguide portion at the rear of the antenna which houses the feed probe. The antenna of this invention eliminates this portion, further reducing the size of the antenna and the materials used. Flaring wall 16 produces a phase lag in the electrical field distribution at aperture 38. This creates a natural beam tilt with respect to axis 14 toward wall 16 indicated by arrow 40 which represents the beam squint (the center of the beam).

The beam tilt may be increased by providing tuning reflector 34 which introduces additional phase lag or delay to control beam squint 40; longer strips cause more delay and hence more beam squint. By moving tuning reflector 34 away from wall 16 in the direction of arrow 42, the beam tilt decreases with respect to primary axis 14.

Accordingly, the position of tuning reflector 34 can be used to adjust the beam squint depending on how the antenna must be mounted to provide the desired radiation pattern. However, tuning reflector 34 should not be positioned too close to aperture 38. Placing tuning reflector 34 too close to aperture 38 distorts the amplitude distribution at aperture 38 resulting in main beam split (or depression).

The flare angle $\alpha$, FIG. 3B, also controls the beam squint. By increasing $\alpha$, the beam tilt with respect to primary axis 14 can be increased. The beam tilt may also be increased by increasing the length L of antenna 10. However, this necessarily increases the size of the antenna.

The inherent beam squint is found to be proportional to:

$$L\left(\frac{1}{\sin\alpha}-1\right) \quad \text{for} \quad \alpha \geq 90°$$

Figure 4B:
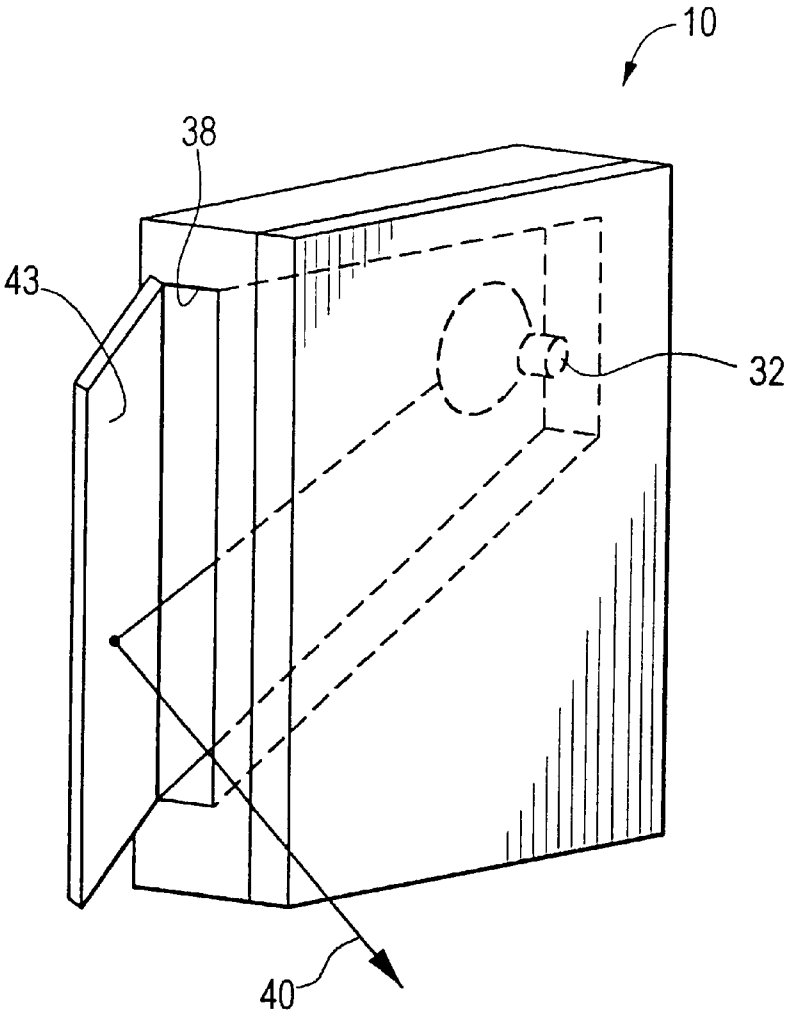
FIG. 4B is an isometric view of the horn antenna according to the present invention in which an angled reflector redirects the beam forward.
Figure 4A:
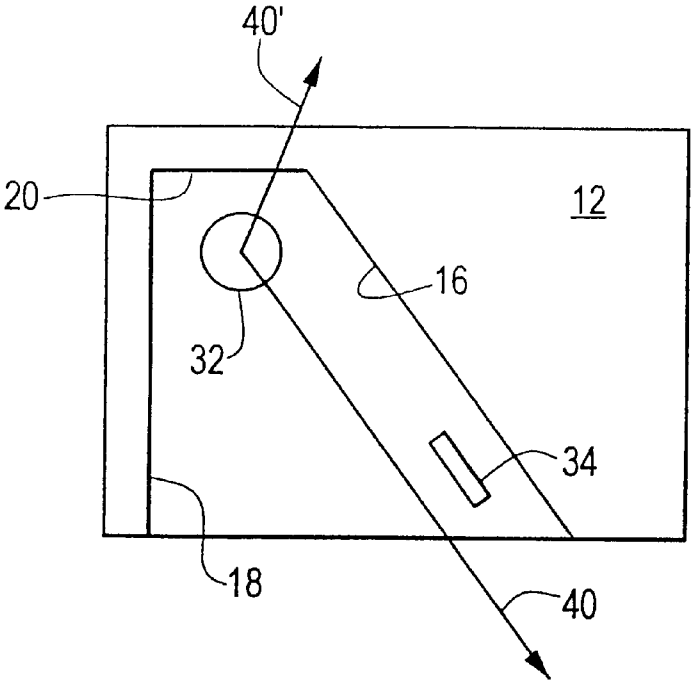
FIG. 4A is a schematic view of the front and rear beam tilt produced by the miniature horn antenna according to the present invention.

A further advantage of skewed beam antenna 10, FIG. 4A, is that the forward to backward radiation ratio is much higher than a conventional symmetrical horn antenna.

By producing less backward radiation 40' antenna 10 is less susceptible to reflections from objects behind antenna 10, which was previously unavailable, while reducing errant reflections which could affect the accurate detection of objects when used in a crash detection system. The backward radiation is due to the edge diffraction. The illumination of the edge of side 16 lags the illumination of the edge of side 18, thus backward beam tilts toward side 16. Thus, by adjusting the position and the dimensions of reflector 34, the antenna length L and the flare angle $\alpha$, the beam squint 40 can be adjusted to accommodate different mounting orientations of horn antenna 10. Moreover, with the addition of an angled aperture reflector 43, FIG. 4B, horn antenna 10 can be oriented at an angle and still direct the beam squint 40 in a forward direction. This provides an even wider latitude for antenna mounting orientations while providing the desired radiation pattern.

Feed probe 32 capacitively couples with housing 12, matching the impedance to approximately 50 ohms, creating a capacitive reactance which tunes feed probe 32 to the frequency of the electromagnetic energy produced. This creates an effective coupling of feed probe 32 to housing 12 so that the electromagnetic energy will radiate from the front of horn antenna 10. Capacitively coupling the probe with the housing not only provides a good impedance match, but allows operation of the antenna over a broad band of frequencies, greater than 300 MHz. This is due to the inductive reactance of the back-wall reflections combined with the capacitive coupling reactance. Moreover, with such a wide band width, the antenna is more forgiving to manufacturing tolerances such as probe location, wall height and wall width, further reducing manufacturing costs.

Figure 5B:
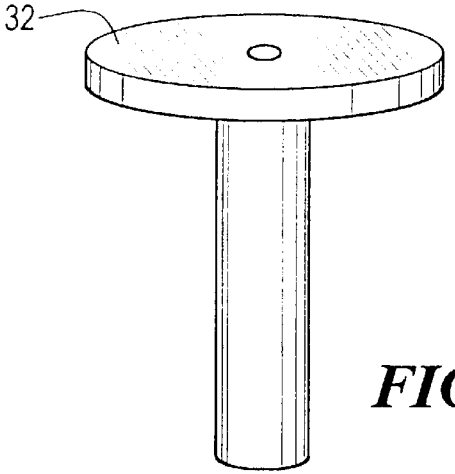
FIG. 5B is a perspective view of a feed probe according to this invention having a disc shape.
Figure 5A:
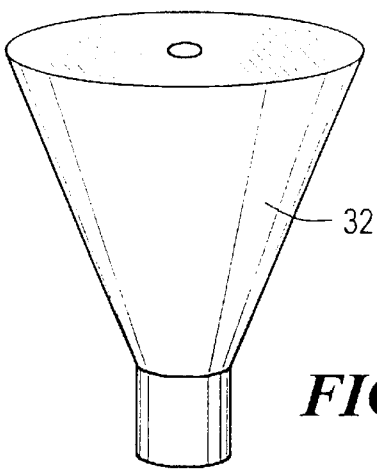
FIG. 5A is a perspective view of a feed probe according to this invention having a conical shape.

Feed probe 32, may consist of a variety of shapes. In the preferred embodiment, feed probe 32, FIG. 5A is cone shaped. However, this is not a necessary limitation of the invention as feed probe 32*a*, FIG. 5B, may include a disc, or feed probe 32*b*, FIG. 5C, may include a cylinder. Because feed probe 32 capacitively couples with side wall 22 in particular, a parallel plate capacitor is achieved by maintaining the end of feed probe 32 flat. The shape of the probe improves the bandwidth and a conical monopole probe has proven to be the best in this respect.

Figure 5D:
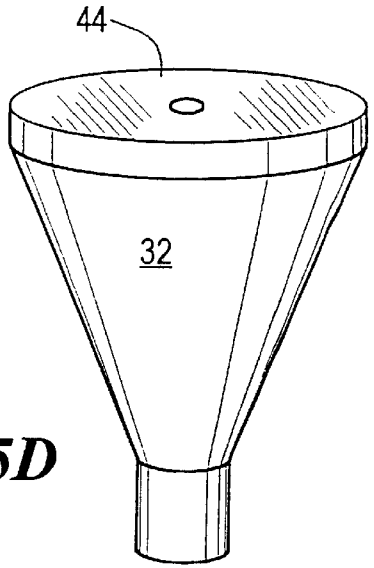
FIG. 5D is a perspective view, similar to FIG. 5A, in which the feed probe includes a dielectric medium.
Figure 5C:
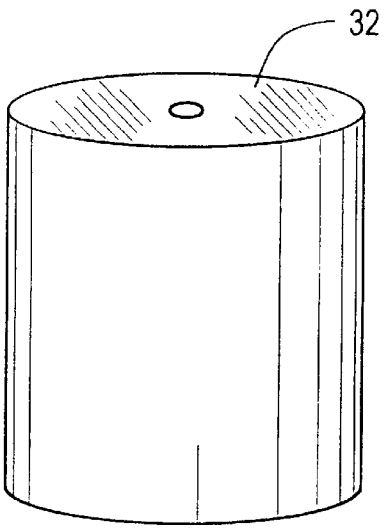
FIG. 5C is a perspective view of a feed probe according to this invention having a cylindrical shape.

The end of feed probe 32, FIG. 5D, may be loaded with a dielectric material 44 in order to increase the effective dielectric constant and thus improve the capacitive coupling of probe 32 with housing 12, FIG. 1.

The length of a typical feed probe is ¼ λ. By capacitively coupling the feed probe to the housing, the feed probe may be shorter than ¼ λ, allowing for a thinner antenna, while effectively appearing as ¼ λ in length.

Figure 6A:
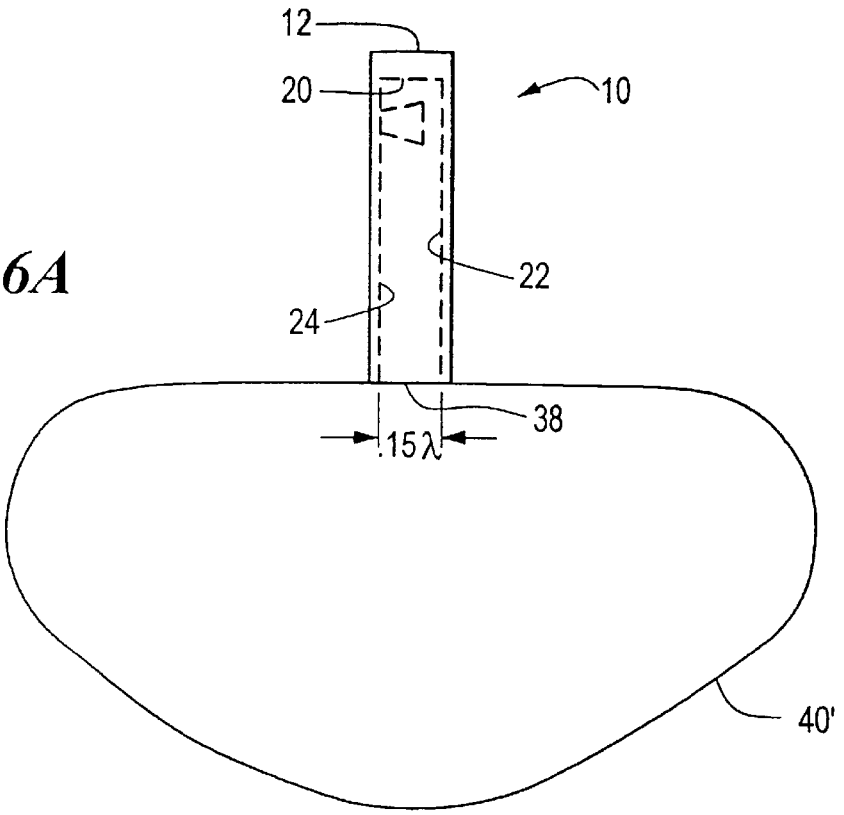
FIG. 6A is a schematic view of a miniature skewed beam horn antenna according to the present invention in which the horizontal beam width approaches 180°.
Figure 6B:
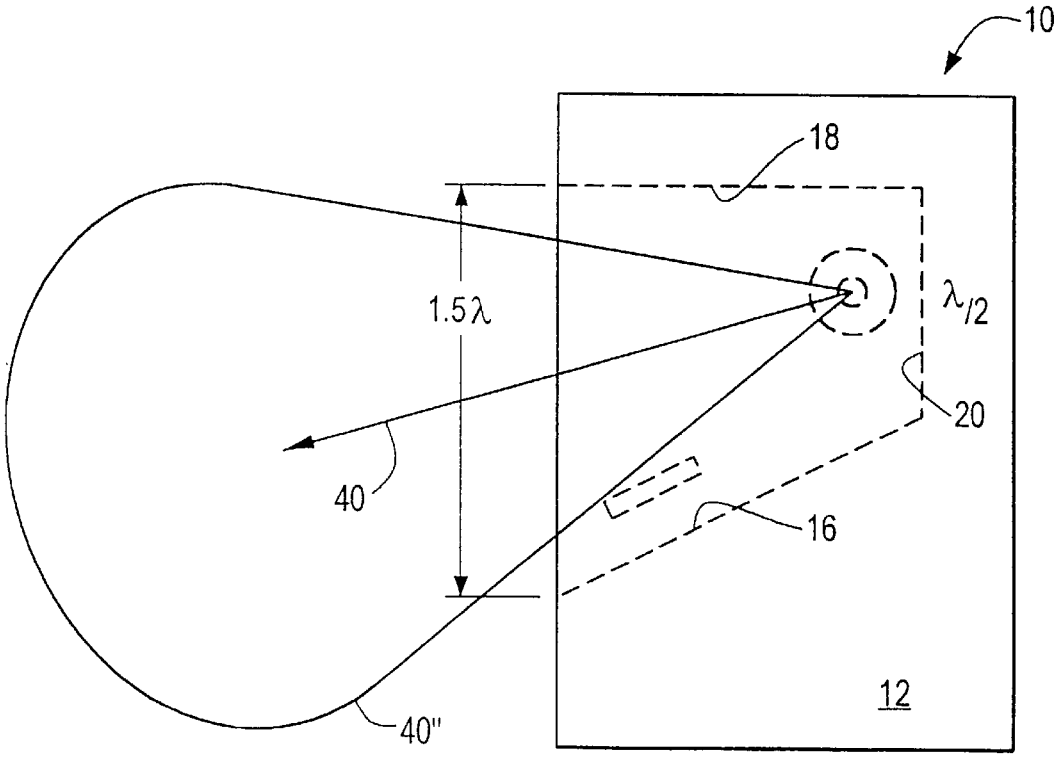
FIG. 6B is a schematic view, similar to FIG. 6A, in which vertical beam width approaches 40°.

The beam width is inversely proportional to the dimensions of aperture 38, FIG. 6A. Thus, the narrower aperture 38 the wider the beam while the longer aperture 38, the narrower the beam width. Shortening the length of feed probe 32 allows the width of aperture 38 to be narrower, for example 0.15 λ. This provides a horizontal beam width of approximately 180° represented by lobe 40", which, when used in a pre-crash sensor for an automobile, provides a much larger area for detecting an approaching object than prior art antennas which provide less than 100°. Similarly, lengthening aperture 38, FIG. 6B, for example 1.5 λ, provides a vertical beam width of 40°.

Although specific features of this invention are shown in some drawings and not others, this is for convenience only as each feature may be combined with any or all of the other features in accordance with the invention.

Other embodiments will occur to those skilled in the art and are within the following claims:

What is claimed is:

1. A miniature horn antenna comprising:

a housing forming a skewed beam sectoral horn, said housing forming first and second divergent walls having a primary axis in which at least one of said first and second divergent walls is transverse to said primary axis, a rear wall joining said first and second divergent walls, and a first side wall; a feed probe in front of said rear wall and between said first and second divergent walls; a harmonic suppressor between said rear wall and said feed probe for minimizing radiation of a predetermined harmonic; and a second side wall.

2. The miniature horn antenna of claim 1 in which said predetermined harmonic includes a second harmonic.

3. A miniature horn antenna comprising:

a housing forming a skewed beam sectoral horn, said housing forming first and second divergent walls having a primary axis in which at least one of said first and second divergent walls is transverse to said primary axis, a rear wall joining said first and second divergent walls, and a first side wall; a feed probe in front of said rear wall and between said first and second divergent walls; a second side wall; and a tuning reflector parallel to one of said first or said second divergent walls.

4. The miniature horn antenna of claim 3 in which said feed probe is capacitively coupled with said housing.

5. The miniature horn antenna of claim 4 in which said feed probe includes a flat end to capacitively couple said feed probe and said housing.

6. The miniature horn antenna of claim 5 in which said feed probe has a conical shape.

7. The miniature horn antenna of claim 5 in which said feed probe has a cylindrical shape.

8. The miniature horn antenna of claim 5 in which said feed probe has a disc shape.

9. The miniature horn antenna of claim 5 in which said feed probe includes a dielectric medium for capacitively coupling said feed probe to said housing.

10. The miniature horn antenna of claim 4 in which said feed probe extends through one of said first and second side walls.

11. The miniature horn antenna of claim 10 in which said second side wall is formed by a ground plane of a printed circuit board.

12. The miniature horn antenna of claim 11 in which said printed circuit board includes circuitry for providing electromagnetic energy to said feed probe.

13. A miniature horn antenna comprising:

a housing forming a skewed beam sectoral, said housing forming first and second divergent walls having a primary axis in which at least one of said first and second divergent walls is transverse to said primary axis, the other of said first and second divergent walls is parallel to said primary axis; a rear wall joining said first and second divergent walls, and a first side wall; a feed probe in front of said rear wall and between said first and second divergent walls; and a second side wall.

* * * * *